US005697025A

United States Patent [19]

Tokimatsu et al.

[11] Patent Number: 5,697,025

[45] Date of Patent: Dec. 9, 1997

[54] COLOR IMAGE FORMING APPARATUS

[75] Inventors: Hiroyuki Tokimatsu; Satoshi Haneda, both of Hachioji, Japan

[73] Assignee: Konica Corporation, Tokyo, Japan

[21] Appl. No.: 601,947

[22] Filed: Feb. 15, 1996

[30] Foreign Application Priority Data

Feb. 24, 1995 [JP] Japan ..... 7-037067

[51] Int. Cl.[6] ..... G03G 15/00

[52] U.S. Cl. ..... 399/159

[58] Field of Search ..... 399/159, 178, 399/223; 347/115, 232

[56] References Cited

U.S. PATENT DOCUMENTS

| | | | |
|---|---|---|---|
| 3,836,363 | 9/1974 | Plutchak | 399/159 X |
| 4,803,514 | 2/1989 | Hiratsuka et al. | 399/178 |
| 4,961,094 | 10/1990 | Yamaoki et al. | 399/232 |
| 5,537,199 | 7/1996 | Takai et al. | 399/159 X |
| 5,541,722 | 7/1996 | Ikeda et al. | 399/178 |
| 5,608,497 | 3/1997 | Haneda et al. | 399/223 X |

*Primary Examiner*—William J. Royer
*Attorney, Agent, or Firm*—Frishauf, Holtz, Goodman, Langer & Chick, P.C.

[57] ABSTRACT

A color image forming apparatus includes a plurality of chargers, imagewise exposure devices and developing devices. During a single rotation of an image forming body, a sequence of charging, exposing and developing is repeated to superimpose toner images, and then the toner images are transferred onto a recording medium. Each exposing position on a circumferential surface of the image forming body is arranged downstream of a developer casing and upstream of a line connecting the centers of the image forming body and developing sleeve. The following expression is satisfied:

$$L_1>L_2>vT+w$$

where $L_1$ represents a circumferential distance along the periphery of the image forming body between the line connecting the rotational center of the image forming body and the tip end of the developing casing and a line connecting the rotational center of the image forming body and the rotational center of the developing sleeve; $L_2$ represents a circumferential distance along the periphery of the image forming body between the exposing position and the line connecting the rotational center of the image forming body and the rotational center of the developing sleeve; w represents a width of a developing area upstream of a position, where a gap between a peripheral surface of the image forming body and a peripheral surface of the developing sleeve is minimum; T represents a decay time of a potential on the image forming body after imagewise exposing is conducted; and v represents a circumferential speed of the image forming body.

5 Claims, 5 Drawing Sheets

COLOR IMAGE FORMING APPARATUS

BACKGROUND OF THE INVENTION

The present invention relates to an electrophotographic color image forming apparatus in which a plurality of image-wise exposure means and developing means are arranged around the peripheral surface of an image forming body, and toner images are superimposed on the image forming body during a single rotation of the image forming body, and specifically to a color image forming apparatus in which image-wise exposure means are provided in the image forming body.

The following apparatus are widely known as multi-color image forming methods. (A): a color image forming apparatus which is provided with the same number of photoreceptors, chargers and developing units as the number of required colors, and in which mono-color toner images respectively formed on the respective photoreceptors, are superimposed on a transfer body. (B): a color image forming apparatus in which a photoreceptor is rotated plural times, and charging, image-wise exposure and developing for each color are repeated. (C): a color image forming apparatus in which charging, image-wise exposure and developing for each color are successively conducted during a single rotation of the photoreceptor.

However, the above-described apparatus (A) has the disadvantage in that dimensions of the apparatus are excessively large because of the plurality of photoreceptors or conveyance means of the transfer body. On the other hand, dimensions of the apparatus (B) are reduced due to only one charging means, image-wise exposure means and photoreceptor, but the size of the formed image is limited within the surface area of the photoreceptor.

Further, in the apparatus (C), although high speed image formation can be carried out, it is necessary that a charger, an image-wise exposure means, and a plurality of developing units are arranged within the periphery of the photoreceptor; since an image-wise optical system is stained by toner leaking from developing units near the optical system, resulting in deterioration of image quality, it is necessary that the distance between the image-wise exposure means and the developing unit be increased in order to protect the optical system from being stained, and unnecessarily the diameter of the photoreceptor is increased, resulting in an overall increase of the apparatus size, which is contrary to the object of the invention.

In order to overcome the above-described disadvantages in the apparatus (C), the following apparatus is proposed. An image forming apparatus in which a base body of the image forming body is formed of a transparent material; a plurality of image-wise exposure means are accommodated in the base body; and images are exposed through the base body onto a photoreceptor layer formed around the base body, (for example, Japanese Patent Publication Open to Public Inspection No.307307/1993).

However, in the apparatus in which the image exposure means is accommodated in the image forming body, an exposure beam transmitted through the photoreceptor layer is reflected inside the apparatus, and the photoreceptor layer is re-exposed by the reflected light beam. Therefore, the latent image which has been formed by the exposure, is affected by the reflected light beam, and is disturbed.

Further, when the image forming body already carries toner images, and toner images are superimposed thereon and image-wise exposed, there is a possibility that toner of a portion of the toner image is floated at the position in which the image forming body is discharged by the exposure, and scatters from the image forming body.

SUMMARY OF THE INVENTION

An object of the present invention is to provide a color image forming apparatus in which the image quality of a formed image is not lowered even when toner adhered onto the image forming body is scattered by the image-wise exposure conducted before development, and floats freely in the apparatus, and thereby staining occurs inside the apparatus.

The above-described object is attained by a color image forming apparatus structured as follows. In a color image forming apparatus in which a plurality of charging means, image-wise exposure means and developing means are arranged around an image forming body; and after a toner image is superimposed on the image forming body by repeating charging, image-wise exposure, and developing during a single rotation of the image forming body, the toner image is collectively transferred onto a transfer material. Each of the image-wise exposure means is arranged inside the image forming body, and an image-wise exposure position by the image-wise exposure means is within a development casing of the developing means, the distance on the image forming body from the development center to the development casing is $L_1$, the distance on the image forming body from the development center to the image-wise exposure position is $L_2$, the width in the upstream direction of the development area from the development center is W, the potential voltage lowering time of the image forming body is T, and the peripheral speed of the image forming body is V, then, $L_1>L_2>VT+W$.

In a color image forming apparatus of the present invention, a position of image exposure from the inside of the image forming body, conducted before development, is set in a developing case of the developing unit ($L_1>L_2$), and thereby, the space for any floating toner is limited inside the developing unit, and staining in the apparatus is prevented, even when adhered toner is scattered by the image-wise exposure.

When the image-wise exposure is conducted in the development casing, the image-wise exposure position is close to the developing area. Due to study by the present inventors, the following was found: it is necessary that the development, under the condition that adhered toner exists on the image forming body, is conducted after the potential voltage of the photoreceptor is sufficiently lowered by the image-wise exposure (the ratio of the potential voltage reduction is more than 90%). FIG. 5 shows a change of the charged potential voltage when image-wise exposure is conducted on the photoreceptor which is in a charged condition. It is necessary that the development is conducted after the potential voltage lowering time T. The potential voltage lowering time of the organic photoreceptor type image forming body has a tendency to be longer than that of a selenium type image forming body, and therefore, more attention is necessary.

While the potential voltage of the image forming body is being lowered, the adhesive force of the toner onto the image forming body is also lowered, and the toner tends to float. Accordingly, when an image is developed during this time, the previously adhered toner easily peels away. When development is not conducted after floating toner from the image forming body steadily adheres onto the image forming body, the previously adhered toner easily peels off, and thereby the image quality is lowered at the time of development. FIG. 4 shows the above-described relationship. It is necessary that the ratio of potential voltage reduction of the image forming body is more than 90% before an image portion on the image forming body reaches the developing area ($L_2$>VT+W).

DETAILED DESCRIPTION OF THE PREFERRED EMBODIMENT

Figure 1:
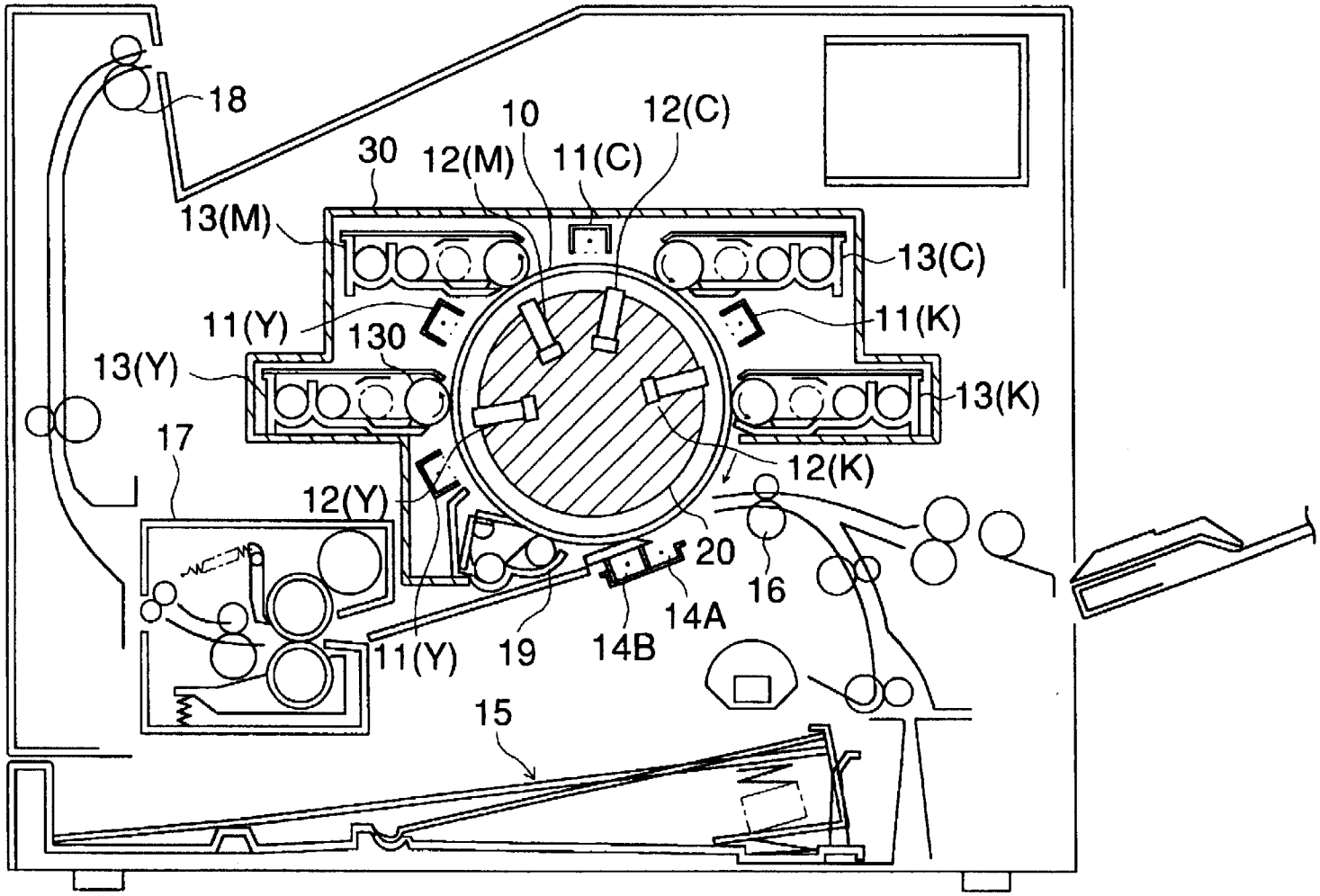
FIG. 1 is a sectional structural view showing an example of a color image forming apparatus according to the present invention.
Figure 2:
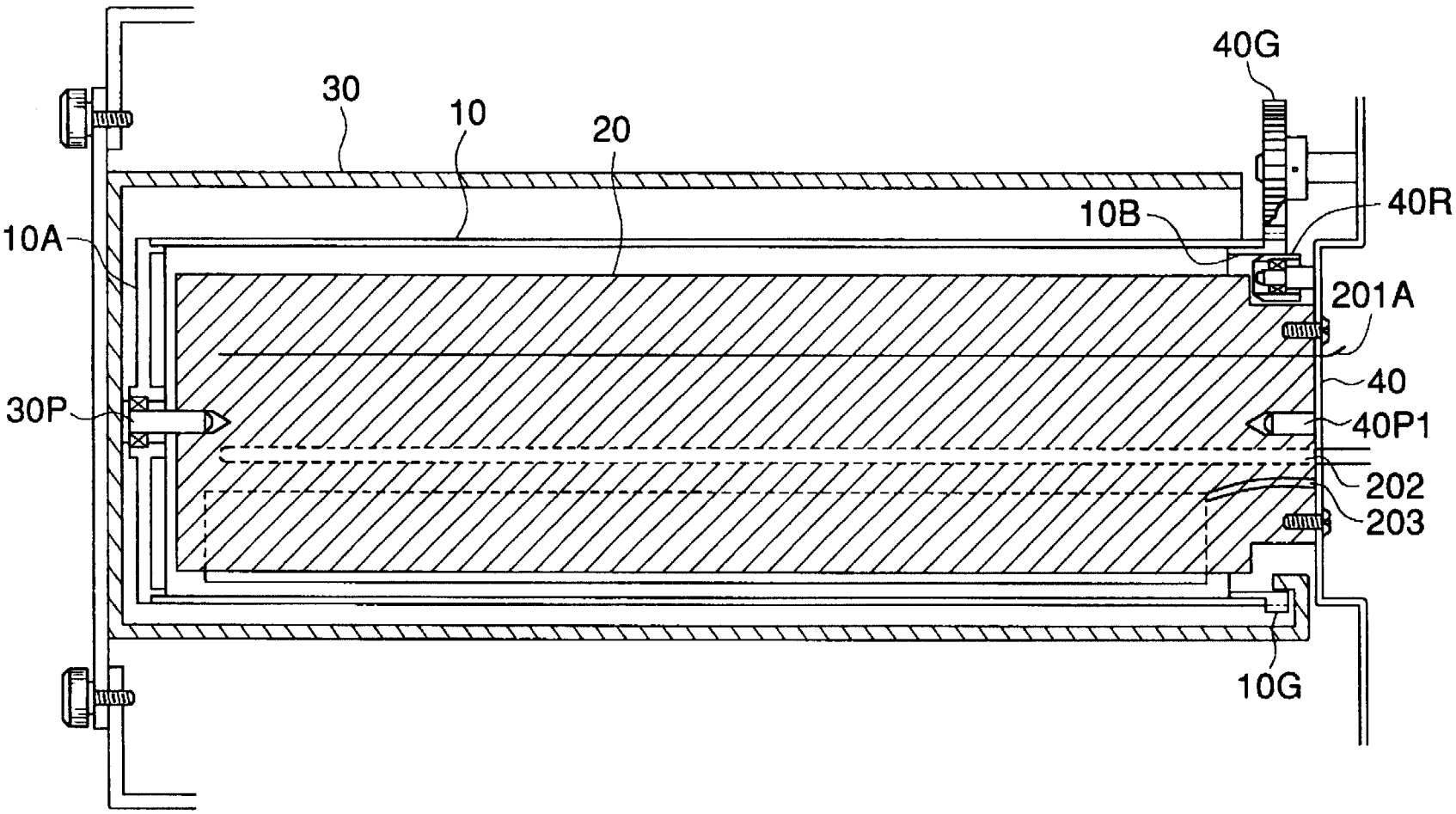
FIG. 2 is a sectional view showing the relationship of a photoreceptor drum with an exposure optical system.

Referring to FIGS. 1 and 2, the overall structure of a color image forming apparatus will be described below prior to the description of the present invention.

Numeral 10 is a drum-like image forming body, that is, a photoreceptor drum, in which a transparent conductive layer, or an organic photosensitive layer (OPC) is coated on the outer periphery of a cylindrical base body formed of a transparent material such as optical glass, transparent acrylic resin, or the like.

In the present invention, it is acceptable that a light beam for the image-wise exposure has a quantity of light for exposure, the wavelength of which can apply an appropriate contrast with respect to light decay characteristics (generation of light beam carrier) of the light conductive layer, in the light conductive layer on the photoreceptor drum which is an image formation point of the exposure light beam for image-wise exposure. Accordingly, it is not necessary that the light transmission ratio of the transparent base body of the photoreceptor drum of the present invention be 100%, and a certain amount of light is allowed to be absorbed at the time of transmission of the exposure light beam. For the material of the light transmissive base body, the following materials may be used: soda glass, Pyrex glass, boro-silicated glass, or light transmissive resins, used for general optical members, such as fluorine, polyester, polycarbonate, polyethylene terephthalate, etc. For a light transmission conductive layer, the following may be used: a light transmissivity-maintaining thin metallic film formed of indium, tin-oxide (ITO), tin oxide, lead oxide, indium oxide, copper iodide, Au, Ag, Ni, Al, etc. For a film forming method, the following methods may be used: vacuum evaporation method, active response evaporation method, spattering methods, CVD methods, dip coating method, spray coating method, etc. For a photoconductive layer, the following layers may be used: amorphous silicon (a-Si) alloy photosensitive layer, amorphous selenium alloy photosensitive layer or each type organic photosensitive layer (OPC).

A flange 10A, provided on an end portion of the photoreceptor drum 10, is supported by a guide pin 30P provided in a cartridge 30, which will be described later, and a flange 10B, provided on another end portion of the photoreceptor drum 10, is externally engaged with a plurality of guide rollers 40R provided on the base plate 40 of the apparatus main body. A gear 10G provided on the outer periphery of the photoreceptor drum 10 is engaged with the drive gear 40G, and thereby, the photoreceptor drum is rotated clockwise while the transparent conductive layer is being electrically grounded.

Numerals 11(Y, M, C, K) are scorotron chargers, which charge the organic photoreceptor layer on the photoreceptor drum 10 by corona discharge using grids having a predetermined potential voltage and discharge wires, and apply a uniform potential voltage onto the photoreceptor drum 10.

Numerals 12(Y, M, C, K) are exposure optical systems composed of: light emitting elements such as FLs, ELs, PLs, and LEDs, set in an array in the axial direction of the photoreceptor drum 10; LISA, PLZT, LCS in which light emitting elements and elements having optical shutter functions are arranged in a row; and a SELFOC lens as a life-size image formation element. Each color image signal read by an image reading device, which is provided separately from the apparatus, is successively read from a memory, and is respectively inputted into each exposure optical system 12(Y, M, C, K) as an electric signal.

Each exposure optical system 12(Y, M, C, K) is attached to a cylindrical supporting member 20 which is fixed to a base plate 40 of the apparatus main body guided by a guide pin 40P1, and is accommodated inside the base body of the photoreceptor drum 20.

Numerals 13(Y, M, C, K) are developing units in which developers yellow (Y), magenta (M), cyan (C) and black (K) are respectively accommodated, and each developing unit has a developing sleeve 130 which is rotated in the same direction as the photoreceptor drum 10, at predetermined intervals from the peripheral surface of the photoreceptor drum 10.

Each developing unit contactlessly reversal-develops an electrostatic latent image on the photoreceptor drum 10, formed by charging by the chargers 11(Y, M, C, K) and image-wise exposure by the exposure optical systems 12(Y, M, C, K), when the development bias voltage is applied.

Next, processes of the color image formations in this apparatus will be described.

A document image, read by the image pick-up element in an image reading device, which is provided separately from this apparatus, or an image edited by a computer, is temporarily stored in a memory as an image signal for each color, Y, M, C and K.

A photoreceptor drive motor is rotated when image recording starts, the drive gear 40G is rotated and the photoreceptor drum 10 is rotated clockwise. Simultaneously, potential voltage application onto the photoreceptor drum 10 starts by charging action of the charger 11(Y).

After the potential voltage has been applied onto the photoreceptor drum 10, the image-wise exposure is started by an electric signal corresponding to an image signal of the first color signal, that is yellow (Y), in the exposure optical system 12(Y). An electrostatic latent image corresponding to a yellow (Y) image in the document image is formed on the photoreceptor layer, provided on the peripheral surface of the photoreceptor drum, by rotational scanning of the photoreceptor drum.

This latent image is reversal-developed contactlessly by the developer on the developing sleeve provided in the developing unit 13(Y), and a yellow (Y) toner image is formed corresponding to the rotation of the photoreceptor drum 10.

Next, a potential voltage is further applied on the yellow (Y) toner image on the photoreceptor drum 10 by the charging action of the charger 11 (M). The image-wise exposure is conducted by an electric signal corresponding to an image signal of the second color Signal in the exposure optical system 12 (M), i.e., magenta (M). The magenta (M) toner image is formed by being superimposed on the yellow (Y) toner image by contactless reversal development by the developing unit 13(M).

By the same processes as described above, the cyan (C) toner image corresponding to the third color signal is formed by being superimposed on the photoreceptor drum by the charger 11(C), the exposure optical system 12(C) and the developing unit 13 (C). Finally, the black (K) toner image corresponding to the fourth color signal is formed by being superimposed on the photoreceptor drum by the charger 11 (K), exposure optical system 12 (K) and the developing unit 13 (K). Thus, a full color toner image is formed on the peripheral surface of the photoreceptor drum 10 during a single rotation of the photoreceptor drum.

The exposure onto the organic photoreceptor layer of the photoreceptor drum 10 by each exposure optical system is conducted through the transparent base body from inside the drum. Accordingly, exposure of the images corresponding to the second, third, and fourth color signals, is respectively conducted without any influence of the previously formed toner images, and electrostatic latent images having the same image quality as that of an image corresponding to the first color signal can be formed. In this connection, temperature stabilization and temperature-rise prevention in the photoreceptor drum 10 due to heat generation of each exposure optical system 12(Y, M, C, K), can be satisfactorily carried out when good heat-conductivity material is used for the supporting member 20; a heater 201A is used for processing in low temperature conditions; or heat is diffused outside the apparatus through a heat pipe 202 for processing in high temperature conditions. Further, in the developing action by each developing unit, a developing bias DC voltage, or an AC voltage superimposed on the DC voltage, is applied on the developing sleeve 130; jumping development is conducted by one component or two-component developer accommodated in the developing unit; a DC bias voltage, having the same polarity as the toner, is applied onto the photoreceptor drum 10 in which a transparent conductive layer is electrically grounded; and contactless reversal development is conducted so that toner adheres to the exposed portions.

The color toner image formed on the peripheral surface of the photoreceptor drum 10, is transferred by a transfer unit 14A onto a transfer sheet which is conveyed from a sheet feed cassette 15, and is fed synchronously with the photoreceptor drum by the drive of a timing roller 16.

The transfer sheet, onto which a toner image is transferred, is discharged by a discharger 14B, separated from the peripheral surface of the photoreceptor drum, and after toner is fused to the transfer sheet in a fixing device 17, the transfer sheet is delivered onto a tray, provided in the upper portion of the apparatus, by a sheet delivery roller 18.

On the other hand, the remaining toner on the photoreceptor drum 10, from which the transfer sheet has been separated, is removed, and the photoreceptor drum 10 is cleaned, by a cleaning unit 19, and toner image formation of the document image is continued, or the photoreceptor drum is stopped once and waits for toner image formation of new document images.

The photoreceptor drum 10, each charger 11(Y, M, C, K), each developing unit 13(Y, M, C, K) and the Cleaning unit 19 are structured such that any mechanical load or impact is not applied to the image-wise exposure means under the condition that they are accommodated in and integrated with the cartridge 30, and they can be detached from the cartridge in the apparatus main body while the supporting member 20, on which the optical system 12(Y, M, C, K) is provided, remains in its normal position. The structure in which the supporting member 20 remains at the time of attachment and detachment, has advantages in that the heater 201A, a heat pipe 202, a lead wire 203 for the LEDs, and the optical system 12 (Y, M, C, K) can remain fixed on the supporting member 20 even when the photoreceptor drum is rotated or the photoreceptor is attached to or detached from the apparatus. Further, the structure can also be utilized for determining the center of the shaft of the photoreceptor drum 10.

Figure 3:
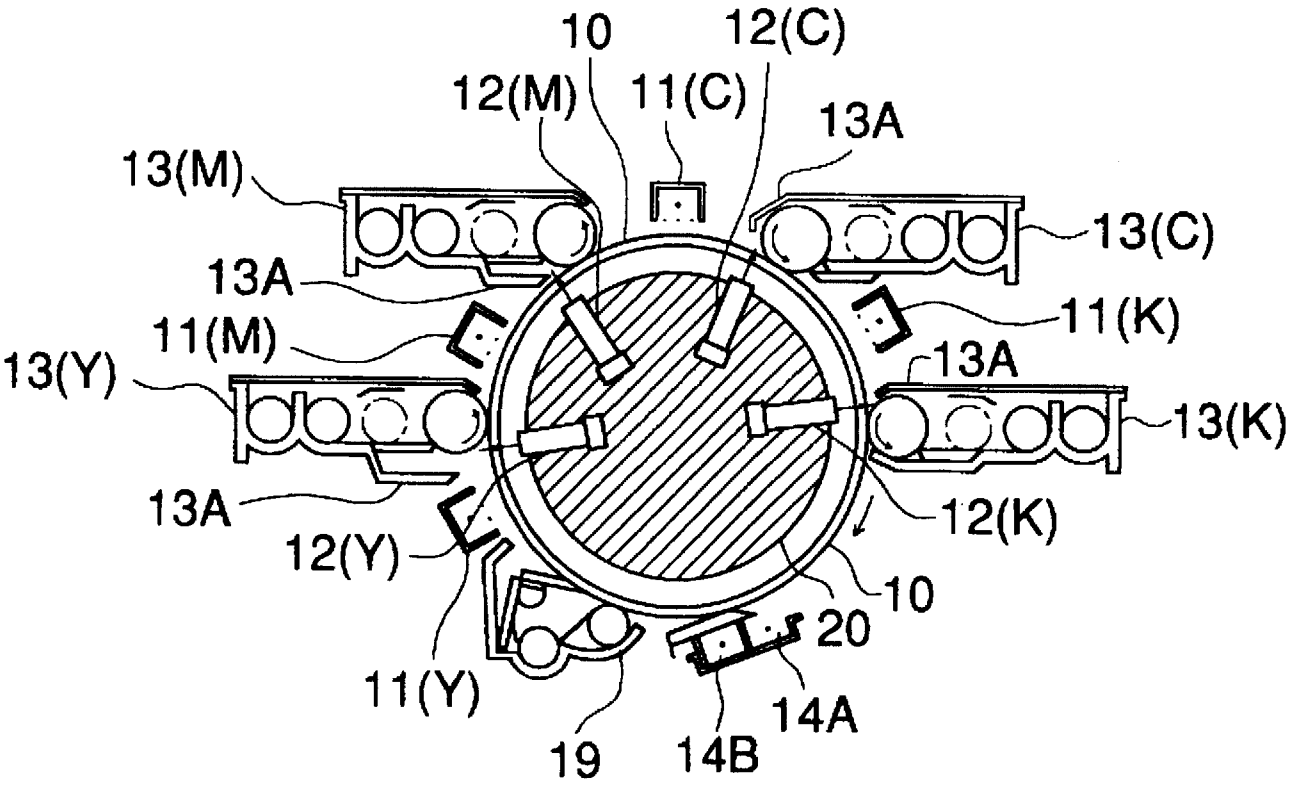
FIG. 3 is an arrangement view of the exposure optical system showing an example of the present invention.
Figure 4:
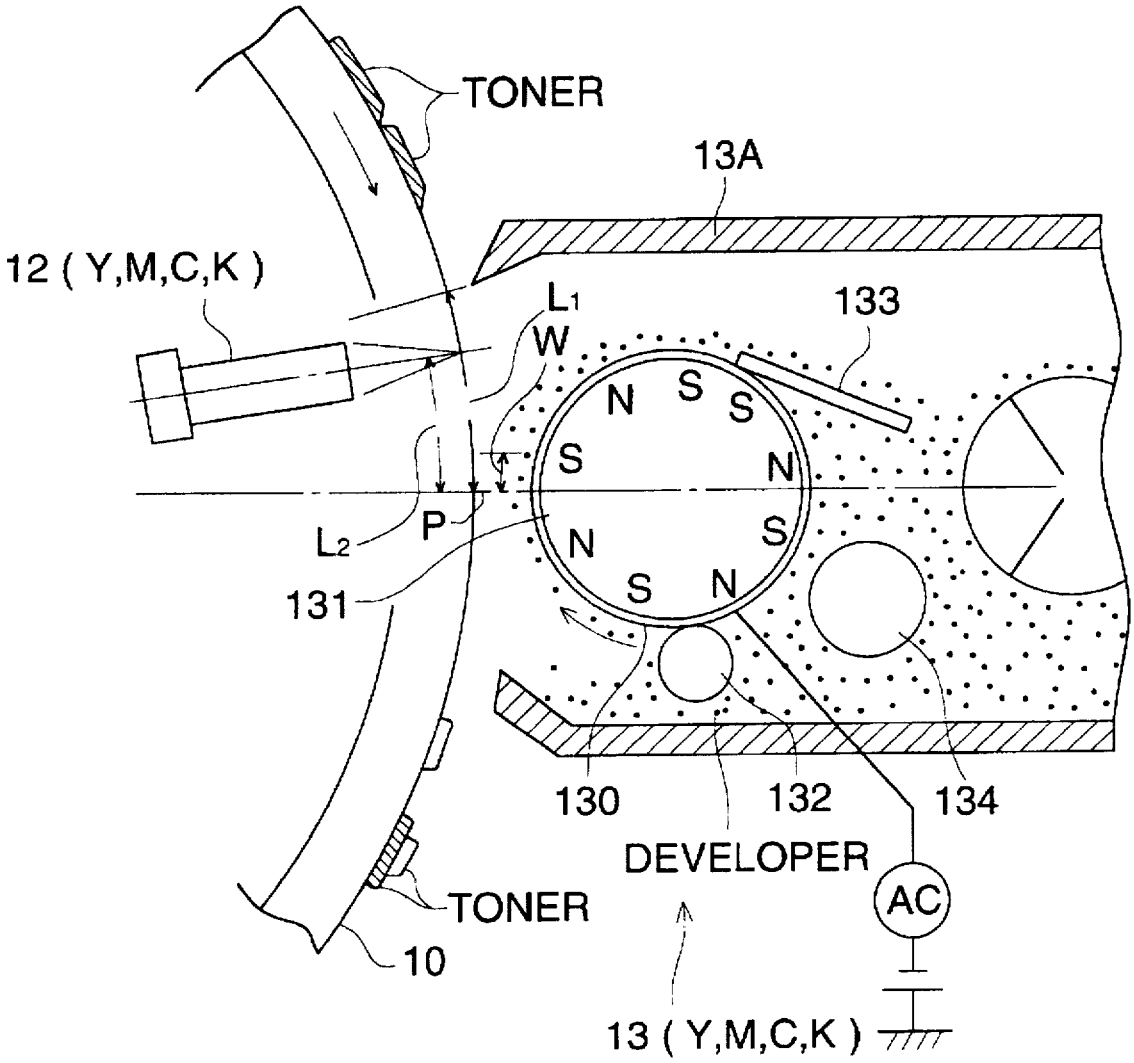
FIG. 4 is an illustration showing an exposure position of the exposure optical system of the present invention.
Figure 5:
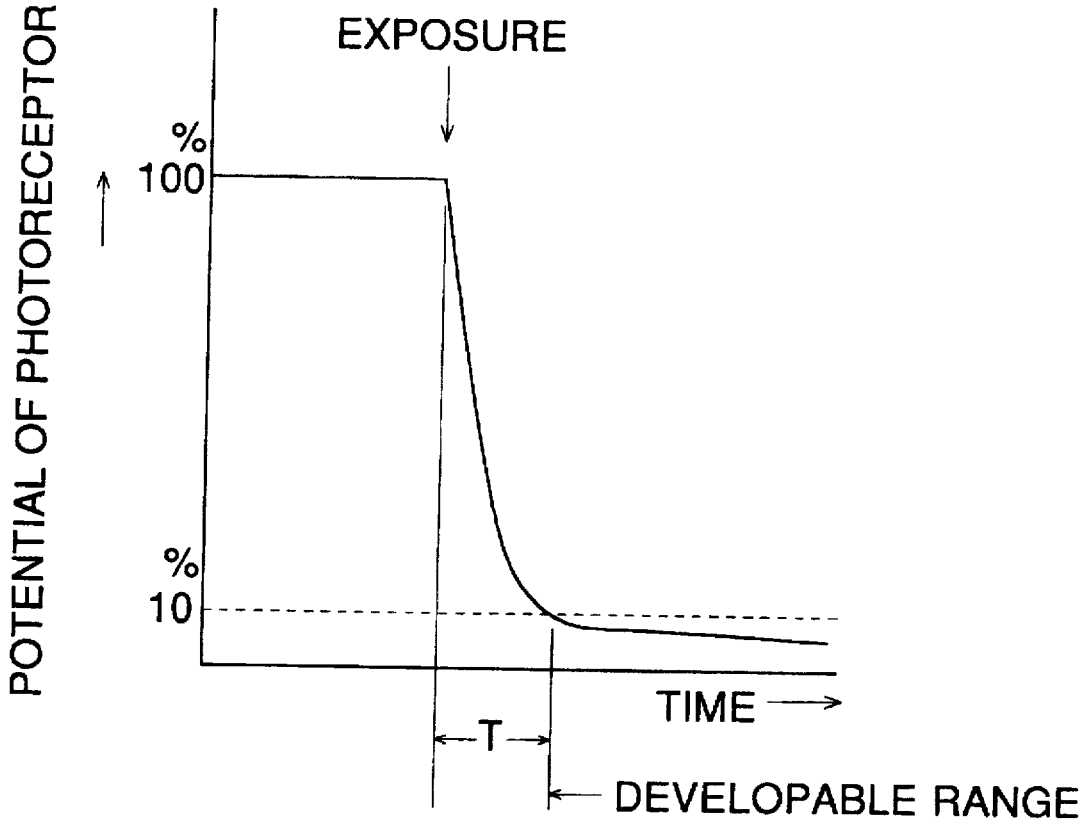
FIG. 5 is a graph showing the potential voltage reduction of the image forming body due to the exposure.

FIG. 3 shows exposure positions of the exposure optical system 12(Y, M, C, K) on the photoreceptor drum 10 which are provided upstream of the developing sleeves 130 in development casings 13A of the developing units 13(Y, M, C, K). FIG. 4 is an illustration showing one such paired system. In FIG. 4, numeral 130 is a developing sleeve which has magnets 131 in its interior. Numeral 132 is a thin developer layer forming member which is provided upstream of the developing area of the rotating developing sleeve 130, and regulates the amount of developer to be conveyed to the developing area. Numeral 133 is a developer scraping member to scrape off any developer adhered to the developing sleeve 130 after development. Numeral 134 is a developer feeding member to supply the newly stirred developer. A developing bias voltage, in which an AC bias voltage is superimposed on a DC bias voltage, is applied onto the developing sleeve 130, and contactless developing is conducted in the developing area closest to the photoreceptor drum 10. In the example shown here, although the developing sleeve 130 is rotated in the direction opposite to the rotation of the photoreceptor drum 10, the present invention is not limited to this.

In the color image forming apparatus of the present invention, the image-wise exposure position by the exposure optical system 12(Y, M, C, K) using LEDs or the like, which is provided inside the photoreceptor drum 10, is provided upstream of the developing sleeve 130 in the development casing 13A. When, the distance on the photoreceptor drum 10 from the development center P, at which the photoreceptor drum 10 is closest to the developing sleeve 130 and which is on a line connecting the center of the photoreceptor drum 10 to the center of the developing sleeve 130, to the upstream end surface of the development casing 13A, is $L_1$; the distance on the photoreceptor drum 10 from the development center P to the image-wise exposure position is $L_2$; the width in the upstream direction of the developing area, in which developing is conducted, from the development center P, is W; the potential voltage lowering time of the organic photoreceptor coated on the photoreceptor drum 10 is T; and the processing speed, that is, the peripheral speed of the photoreceptor drum 10, is V, then, the following relationship is adopted in the apparatus, $L_1>L_2>VT+W$.

In this connection, the present invention can also be applied to a belt-like photoreceptor. At this time, the development center P is an intersection of an imaginary line, connecting the closest position between the photoreceptor belt and the developing sleeve to the center of the developing sleeve, with the photoreceptor.

In the present example, $L_1$ and $L_2$ are set between 3–30 mm. The processing speed V is 30–300 mm/sec. The potential voltage lowering time T of the organic photoreceptor used in the present example, which is easily found in the experiments, is less than 0.1 sec. The width W of the developing area is normally 1–2 mm.

Accordingly, when the processing speed V is 30–300 mm/sec, and the potential voltage lowering time T is 0.1 sec, $$VT+W=4\text{–}32 \text{ mm.}$$

When the processing speed V is 30–300 mm/sec, and the potential voltage lowering time T is 0.05 sec, $$VT+W=2.5\text{–}17 \text{ mm.}$$

When the image-wise exposure is conducted at a position which satisfies the relationships $L_2$>3–32 mm, or $L_2$>2.5–17 mm, the potential voltage of the photoreceptor is satisfactorily lowered, and succeeding developing is conducted under the conditions that the preceding toner image is stably adhered onto the image forming body.

In the present invention, an exposure optical system as an image-wise exposure means is arranged inside the photoreceptor drum and the image-wise exposure is conducted from the rear of the image forming body. Accordingly, the image-wise exposure position can be selected without restriction. The image-wise exposure position is set inside the development casing, and the positional relationship is determined such that developing is conducted after the potential voltage of the photoreceptor is greatly lowered due to the image-wise exposure. Therefore, staining inside the apparatus due to toner scattering at the time of the image-wise exposure, is minimized. Further, although a toner image, which has been previously developed and adhered onto the image forming body, has unstable adhering conditions due to the image-wise exposure, developing is conducted after the sequence has advanced from the unstable adhering conditions, resulting in no undesirable color mixture. Accordingly, a compact color image forming apparatus, having higher processability, in which an excellent quality image is obtained, can be realized.

What is claimed is:

1. A color image forming apparatus comprising:

(a) an image forming body for forming an image thereon;

(b) a plurality of charging means each disposed in a periphery of the image forming body for charging the image forming body;

(c) a plurality of imagewise exposure means provided inside the image forming body, for imagewise exposing a charged image forming body to form a latent image; and (d) a plurality of developing means each disposed in the periphery of the image forming body, for developing the latent image to form a toner image, said plurality of developing means each having a developing sleeve and a developing casing, wherein during one rotation of the image forming body a sequence of charging, imagewise exposing and developing is repeated to superimpose the toner images, and wherein an exposing position on a circumferential surface of the image forming body is downstream of a line connecting a rotational center of the image forming body and a tip end of the developing casing and is upstream of a line connecting the rotational center of the image forming body and a rotational center of the developing sleeve with respect to the rotational direction of the image forming body, and wherein the following expression is satisfied:

$$L_1>L_2>vT+w$$

where $L_1$ represents a circumferential distance along the periphery of the image forming body between the line connecting the rotational center of the image forming body and the tip end of the developing casing and a line connecting the rotational center of the image forming body and the rotational center of the developing sleeve; $L_2$ represents a circumferential distance along the periphery of the image forming body between said exposing position and the line connecting the rotational center of the image forming body and the rotational center of the developing sleeve; w represents a width of a developing area upstream of a position, with respect to the rotational direction of the image forming body, where a gap between a peripheral surface of the image forming body and a peripheral surface of the developing sleeve is minimum; T represents a light decay time of a potential voltage on the image forming body after an image-wise exposing is conducted; and v represents a circumferential speed of the image forming body.

2. The apparatus of claim 1, wherein the image forming body is made of an organic photoreceptor.

3. The apparatus of claim 1, wherein T is not more than 0.1 sec.

4. The apparatus of claim 1, wherein v is not less than 30 mm/sec and not more than 300 mm/sec.

5. The apparatus of claim 1, wherein $L_1$ and $L_2$ are not less than 3 mm and not more than 30 mm.

* * * * *